US011715611B2

(12) United States Patent
Bruchschmidt et al.

(10) Patent No.: US 11,715,611 B2
(45) Date of Patent: Aug. 1, 2023

(54) PUSH-BUTTON SWITCH ASSEMBLY WITH MEANS FOR INDICATING A SWITCH STATUS

(71) Applicant: Eaton Intelligent Power Limited, Dublin (IE)

(72) Inventors: Frank Bruchschmidt, Dausenau (DE); Petra Ries, Bonn (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 177 days.

(21) Appl. No.: 17/423,114

(22) PCT Filed: Jan. 13, 2020

(86) PCT No.: PCT/EP2020/050650
§ 371 (c)(1),
(2) Date: Jul. 15, 2021

(87) PCT Pub. No.: WO2020/148208
PCT Pub. Date: Jul. 23, 2020

(65) Prior Publication Data

US 2022/0093349 A1 Mar. 24, 2022

(30) Foreign Application Priority Data

Jan. 18, 2019 (DE) ..... 10 2019 101 265.1

(51) Int. Cl.
*H01H 13/14* (2006.01)
*H01H 13/02* (2006.01)
*H01H 13/56* (2006.01)

(52) U.S. Cl.
CPC ..... *H01H 13/023* (2013.01); *H01H 13/14* (2013.01); *H01H 13/56* (2013.01); *H01H 2219/062* (2013.01)

(58) Field of Classification Search
CPC ..... H01H 13/83; H01H 13/023; H01H 3/125; H01H 13/705; H01H 13/14; H01H 13/04;
(Continued)

(56) References Cited

U.S. PATENT DOCUMENTS 4,314,124 A 2/1982 Sauer et al.
4,404,445 A 9/1983 Baran et al.
(Continued)

FOREIGN PATENT DOCUMENTS

DE 4422171 A1 1/1996
DE 102009007854 A1 8/2010
(Continued)

*Primary Examiner* — Ahmed M Saeed
(74) *Attorney, Agent, or Firm* — Leydig, Voit & Mayer, Ltd.

(57) ABSTRACT

A push-button switch assembly with means for indicating a switch status includes: an actuation head for actuating the push-button switch assembly, the actuation head having a disc-shaped upper part and a tubular lower part; a sleeve-type push-button guide which is coupled to the actuation head such that, in relation to a longitudinal axis of the push-button switch assembly, the upper part is arranged above the push-button guide and the lower part surrounds the push-button guide; a sleeve-type locking unit for determining a switch status of the push-button switch assembly, the sleeve-type locking unit being arranged within the push-button guide in relation to the longitudinal axis and being transferrable between a first and a second locking state by the actuation head, the locking unit having a plunger sleeve and an annular detent catch coupled to the plunger sleeve, which delimit a central through-opening through the locking unit.

8 Claims, 9 Drawing Sheets

(58) Field of Classification Search
CPC ..... H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 6,376,785 | B1 * | 4/2002 | Graninger | H01H 13/503 200/50.02 |
| 2010/0243418 | A1 * | 9/2010 | Machida | H01H 3/022 200/341 |
| 2012/0103774 | A1 | 5/2012 | Jun | |
| 2016/0196933 | A1 * | 7/2016 | Wiese | H01H 3/022 200/341 |
| 2017/0213672 | A1 * | 7/2017 | Shimoyama | H01H 13/14 |

FOREIGN PATENT DOCUMENTS

| | | | |
|---|---|---|---|
| DE | 102009041542 | A1 | 3/2011 |
| EP | 1734434 | A1 | 12/2006 |
| EP | 1261979 | B1 | 5/2007 |

* cited by examiner

PUSH-BUTTON SWITCH ASSEMBLY WITH MEANS FOR INDICATING A SWITCH STATUS

CROSS-REFERENCE TO PRIOR APPLICATIONS

This application is a U.S. National Phase application under 35 U.S.C. § 371 of International Application No. PCT/EP2020/050650, filed on Jan. 13, 2020, and claims benefit to German Patent Application No. DE 10 2019 101 265.1, filed on Jan. 18, 2019. The International Application was published in German on Jul. 23, 2020 as WO 2020/148208 under PCT Article 21(2).

FIELD

The invention relates to a push-button switch assembly in which different switch statuses are visibly indicated on the basis of the switch position.

BACKGROUND

In the case of specific push-button switch assemblies, a standard stipulates that different switch statuses of the push-button switch assembly are clearly recognizable for an observer. The push-button switch assembly is designed, for example, as an emergency stop switch with which an electrical contact between two conductors can be separated.

Such a push-button switch assembly usually has different components which are assembled according to a modular system, as is described, for example, in document EP 1 261 979 B1. The components of a push-button switch assembly include, for example, a generally mushroom-shaped actuation head that is placed on a push-button guide. The push-button guide is designed, for example, as a hollow body and has in its interior, for example, a plunger which is arranged in the push-button guide to be movable in the axial direction by means of the actuation head.

Such a push-button switch assembly is mounted, for example, on a housing body which has a contact element in the interior. When the actuation head is pressed or turned, the plunger is moved in the interior of the push-button guide. The plunger acts on the contact element in the interior of the housing body, so that an electrical contact is, for example, separated. For this purpose, it is necessary to indicate the switch status of the push-button switch assembly in a reliable manner and visible from the outside.

Document EP 1734434 A1 discloses an emergency stop switch having a tubular body which accommodates a tubular part offset by an axial movement. The emergency stop switch further comprises a blocking unit which interacts with indexing slots in starting and re-entry positions. The blocking unit is integrated into the tubular body and has an elastomer material and is thus designed to be partially elastically deformable.

The disclosure of document DE 102009007854 A1 relates to a command device with a backlit handle and a flexible light guide for directing generated light from a light source to the handle for backlighting the handle.

Document U.S. Pat. No. 4,314,124 A discloses a push-button circuit breaker with a contact function and a locking function. Latching means are provided on a confirmation element, which interact with cam surfaces in a guide cylinder of the circuit breaker. Different cam surfaces in the guide cylinder are offset relative to one another and can be brought into operational connection with the latching means.

SUMMARY

In an embodiment, the present invention provides a push-button switch assembly with means for indicating a switch status, comprising: an actuation head configured to actuate the push-button switch assembly, the actuation head having a disc-shaped upper part and a tubular lower part; a sleeve-type push-button guide which is coupled to the actuation head such that, in relation to a longitudinal axis of the push-button switch assembly, the upper part is arranged above the push-button guide and the lower part surrounds the push-button guide; a sleeve-type locking unit configured to determine a switch status of the push-button switch assembly, the sleeve-type locking unit being arranged within the push-button guide in relation to the longitudinal axis and being transferrable between a first and a second locking state by the actuation head, the locking unit having a plunger sleeve and an annular detent catch coupled to the plunger sleeve, which delimit a central through-opening through the locking unit perpendicular to and along the longitudinal axis in a predetermined manner, the detent catch comprising a multipiece design and a first detent catch element and a second detent catch element which are preloaded by two spring elements which, in relation to the longitudinal axis, push the detent catch elements outward; and a light guide configured to guide light, which light guide is coupled to the actuation head such that, in relation to the longitudinal axis, at least portions of the light guide are arranged within the actuation head and within the push-button guide, the light guide, in relation to the longitudinal axis, extending with a top end in a predetermined position through the actuation head and with a bottom end, extending through the through-opening of the locking unit such that the push-button switch assembly is illuminatable in a predetermined manner by a light beam that is couplable into the light guide at the bottom end.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
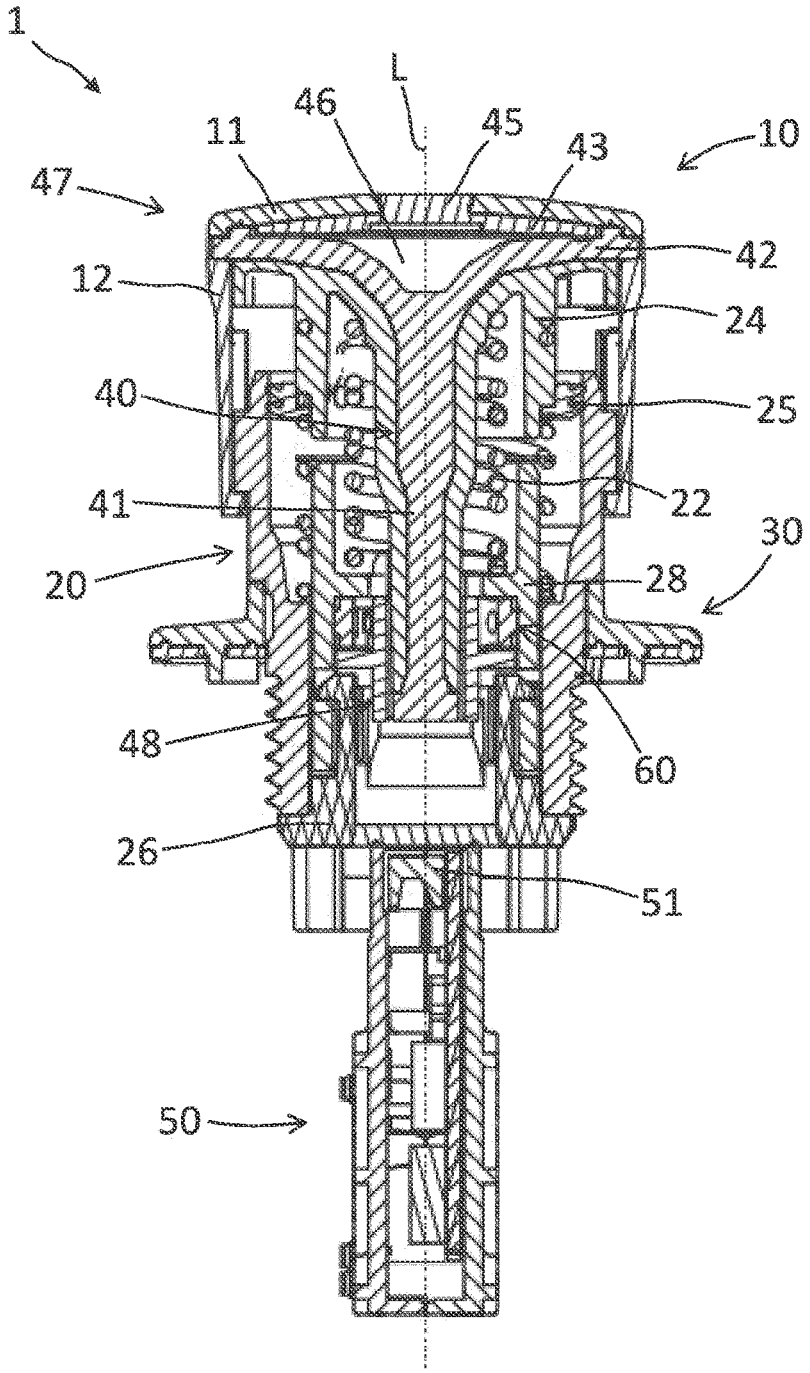
FIG. 1 shows an embodiment of a push-button switch assembly having a light guide.

In an embodiment, the present invention provides a push-button switch assembly which can be manufactured at low production costs, allows for a reliable setting of a switch status and has clearly recognizable means for indicating different switch statuses for an operator.

A push-button switch assembly with means for indicating a switch status is specified herein.

A push-button switch assembly with means for indicating a switch status comprises an actuation head for actuating the push-button switch assembly, having a disc-shaped upper part and a tubular lower part. The push-button switch assembly further comprises a sleeve-type push-button guide which is coupled to the actuation head such that, in relation to a longitudinal axis of the push-button switch assembly, the upper part is arranged above the push-button guide and the lower part surrounds the push-button guide. The push-button switch assembly also comprises a sleeve-type locking unit for determining a switch status of the push-button switch assembly, which is arranged within the push-button guide in relation to the longitudinal axis and can be transferred between a first and a second locking state by means of the actuation head, wherein the locking unit has a plunger sleeve and an annular detent catch coupled to the plunger sleeve, which delimit a central through-opening through the locking unit along the longitudinal axis in a predetermined manner. The detent catch has a multipiece design and a first detent catch element and a second detent catch element which are preloaded by means of two spring elements which, in relation to the longitudinal axis, push the detent catch elements outward. The push-button switch assembly further comprises a light guide for guiding light, which is coupled to the actuation head such that, in relation to the longitudinal axis, at least portions of the light guide are arranged within the actuation head and within the push-button guide. With a top end, the light guide, in relation to the longitudinal axis, extends in a predetermined position through the actuation head, and with a bottom end, it extends through the through-opening of the locking unit such that the push-button switch assembly can be illuminated in a predetermined manner by means of a light beam that can be coupled into the light guide at the bottom end.

By means of the described push-button switch assembly, a switch status can be established reliably and displayed for an operator in a clearly visible manner. The central through-opening through the locking unit allows in particular for an unimpeded passage of light or a light beam. In particular, when using a light source unit that can be fastened to the push-button switch assembly, a beneficial light function of the push-button switch assembly can be made possible. As a result, the push-button switch assembly can be illuminated at one or more predetermined positions in a manner clearly visible from the outside. In this case, the light beam can reach the actuation head free of barriers or unimpeded along the central longitudinal axis, on which, for example, through-openings or a glass window are provided through which at least part of the light beam can exit.

The free through-opening through the locking unit also allows for the installation of a light guide, for example, in the form of a light-guiding glass or polycarbonate rod, which extends through the locking unit to the light source unit and can contribute to a particularly clearly visible illumination or light function of the push-button switch assembly. In addition to conventional color markings, such a light function realizes a light indicator and contributes to a simple and reliable means for indicating a respective switch status.

The central through-opening of the locking unit is free of spring elements or other components of the push-button switch assembly and thus forms a portion of an internal air or light channel that is free of obstructions for a light beam. Therefore, the locking unit designed to be sleeve-like or tubular, in interaction with a light-guiding lighting function, allows for clearly recognizable means for indicating the push-button switch assembly and a respective switch status.

According to a preferred development of the push-button switch assembly, the detent catch of the locking unit has a locking element on an outer side and is preloaded by means of a spring element which, in relation to the longitudinal axis, pushes the detent catch and the locking element outward and away from the longitudinal axis. Such a configuration of the locking unit has a simple and cost-effective structure and also contributes to a safe and reliable locking of a respective switch status. The locking element interacts in particular with adjoining guide tracks and/or recesses which allow for a controlled movement of the locking element when the actuation head is actuated. Furthermore, the guide tracks and/or recesses allow for the locking element to engage or lock in a guided and reliable manner. Recesses in which the locking element engages are provided, for example, as dipping openings on the inner side of the push-button guide. Alternatively, the locking unit is surrounded by a further sleeve-type plunger which has guide tracks and latching openings and interacts with the locking unit for determining a switch status of the push-button switch assembly.

The respective detent catch elements are preferably geometrically identical, in particular symmetrical, and have, for example, a semicircular or sickle-shaped structure. The detent catch elements are arranged, for example, within the annular plunger sleeve, wherein the spring elements are clamped between the detent catch elements at the respective end portions of the detent catch elements and, in relation to the longitudinal axis, push the detent catch elements outward.

According to a further development of the push-button switch assembly, the detent catch elements each have a locking element on an outer side. The respective locking element can be arranged, for example, in a central region of a sickle-shaped detent catch element and extend outward in relation to the central longitudinal axis. The detent catch element is preferably integral with the associated locking element.

According to a further development of the push-button switch assembly, the respective locking element is designed to be bolt-shaped with a rounded end facing away from the central through-opening. Such a shape of the locking element allows for a low-friction guiding and engaging within guide tracks and recesses provided for this purpose. In addition, the locking element can also be designed to be edged or angular and have, for example, a cuboid square structure with bevels which allow for a low-friction guiding and reliable locking of the respective switch status.

According to a further development of the push-button switch assembly, the detent catch, in relation to the longitudinal axis, is arranged within the plunger sleeve, so that the respective locking element extends through an opening in a wall of the plunger sleeve.

According to a further preferred development of the push-button switch assembly, the plunger sleeve and/or the detent catch have guide elements, by means of which the detent catch can be moved in a guided manner relative to the plunger sleeve. For example, raised elongated guide structures are provided on an inner side of the wall of the plunger sleeve and/or on a bottom of the plunger sleeve, which engage in corresponding grooves on the detent catch and predetermine a movement of the detent catch due to an acting spring force along the guide structures.

According to a further particularly preferred development, the push-button switch assembly comprises a light guide for guiding light, which is coupled to the actuation head such that, in relation to the longitudinal axis, at least portions of the light guide are arranged within the actuation head and within the push-button guide. The actuation head is designed, for example, to be mushroom-shaped. With a top end, the light guide, in relation to the longitudinal axis, extends in a predetermined position through the actuation head, and with a bottom end, it extends through the through-opening of the locking unit such that the push-button switch assembly can be illuminated in a predetermined manner by means of a light beam that can be coupled into the light guide at the bottom end.

Preferably, the push-button switch assembly further comprises a light source unit with a light-emitting diode, which, in relation to the longitudinal axis, is coupled to the push-button guide below the locking unit at an end opposite the actuation head, so that the light beam from the light-emitting diode can be emitted unblocked through the through-opening of the locking unit in the direction of the actuation head.

The specific configuration of the locking unit described provides a central free space that can be used for an unimpeded passage of a light beam. In particular, the central free space can be used to guide and accommodate a light guide, thus contributing to the particularly advantageous light guide function and illumination of the push-button switch assembly.

The push-button switch assembly can be switched from a non-released state to a released state by actuating the actuation head, wherein the push-button switch assembly is designed such that, in the released state, an electrical contact between two conductors of a contact element, which can be coupled to the push-button switch assembly, can be separated if the contact element is designed as an N/C contact and the electrical contact between the two conductors is closed in the non-released state. The push-button switch assembly is designed such that, in the released state, an electrical contact between two conductors in the contact element can be closed if the contact element is designed as an N/O contact and the electrical contact between the two conductors is separated in the non-released state.

The push-button switch assembly can be actuated by pressing and/or turning the actuation head and the first or second locking state of the locking unit can thus be set. For example, a locking element in the form of a pin-shaped bolt with a spherical head engages in an opening of an adjacent guide sleeve and forms the first locking state which represents a non-released switch status of the push-button switch assembly. By pressing and/or turning, the locking element is moved out of the recess or opening and moved along a predetermined control path until it engages in a further recess or opening, thus forming the second locking state which represents, for example, a released switch status of the push-button switch assembly.

According to a preferred development, the push-button switch assembly is designed as an emergency stop switch or a stop switch and, by means of the specifically designed locking unit and the preferably provided light guide, allows for a particularly reliable and clearly recognizable display of a switch status and thus contributes to safety.

In addition, the push-button switch assembly can comprise an adapter device for fastening the push-button switch assembly to a housing body, which is coupled to the push-button guide and allows for a fastening to differently sized insertion openings.

Elements with the same structure and function are denoted in all figures with the same reference signs. For the sake of clarity, it is possible that not all of the elements shown are denoted with associated reference signs in all of the figures.

FIG. 1 shows an embodiment of a push-button switch assembly 1 according to the invention with means for indicating a switch status. The push-button switch assembly 1 has a mushroom-shaped actuation head 10 for actuating the push-button switch assembly 1, which comprises a disc-shaped upper part 11 and a tubular lower part 12. The push-button switch assembly 1 also has a push-button guide 20. The push-button guide 20 is coupled to the actuation head 10 and, in relation to a longitudinal axis L of the push-button switch assembly 1, is arranged in the lower part 12 of the actuation head 10 such that the lower part 12 surrounds the push-button guide 20. In relation to the longitudinal axis L, the upper part 11 is arranged above the push-button guide 20.

The push-button switch assembly 1 also has a sleeve-type locking unit 60 for setting a switch status of the push-button switch assembly 1, which, in relation to a longitudinal axis L, is arranged within the push-button guide 20 and which can be transferred between a first and a second locking state by means of the actuation head 10. The locking unit 60 comprises a plunger sleeve 62 and an annular detent catch 61 coupled to the plunger sleeve 62, which delimit a central through-opening 68 through the locking unit along the longitudinal axis L in a predetermined manner (cf. FIG. 3A).

The free through-opening 68 of the locking unit 60 allows for the installation of a light guide 40 which extends through the locking unit 60 and can contribute to a particularly advantageous light guide function and clearly recognizable illumination of the push-button switch assembly 1. In addition to conventional color markings, such a light function realizes a light indicator and contributes to a simple and reliable means for indicating a respective switch status of the push-button switch assembly 1. The central through-opening 68 of the locking unit 60 is free of spring elements or other components of the push-button switch assembly 1 and thus forms a passage free of obstructions for the light beam. This is made possible by the sleeve-type or tubular configuration of the locking unit 60.

The push-button switch assembly 1 further comprises a light guide 40 for guiding light, which is coupled to the actuation head 10 such that, in relation to the longitudinal axis L, the light guide 40 is arranged in portions within the actuation head 10 and within the push-button guide 20. With a top end 47, the light guide 40 extends through the actuation head 10 in a predetermined position such that the push-button switch assembly 1 can be illuminated in a predetermined manner by means of a light beam that, in relation to the longitudinal axis L, can be coupled into the light guide 40 at a bottom end 48 opposite the top end 47.

The light guide 40 is designed in two parts and has a first component with a rod-shaped element 41 and an adjoining funnel-shaped element 42. A separate second component is formed by a disc-shaped element 43 having a protruding region 45 which extends through a central opening in the upper part 11 of the actuation head 10. The light guide 40 also extends outward between the upper part 11 and the lower part 12 through the actuation head 10 and is thus arranged to be continuous between the upper part 11 and the lower part 12.

The depicted components of the push-button switch assembly 1 are, in relation to the longitudinal axis L, predominantly rotationally symmetrical.

The push-button switch assembly 1 also has a sleeve-type plunger 24 which surrounds the light guide 40 in relation to the longitudinal axis L and also extends through the through-opening 68 of the locking unit 60. The sleeve-type plunger 24 is used, among other things, to transmit force, when the actuation head 10 is actuated, to further components of the push-button switch assembly 1, such as the locking unit 60, and, in relation to the longitudinal axis L, is arranged between the actuation head 10 or the push-button guide 20 and the light guide 40. In addition, the plunger 24 can serve as a retaining and coupling component for the light guide 40. The plunger 24 replicates the contour of the light guide 40 or the first component 41, 42 of the light guide 40 and couples the light guide 40 to the actuation head 10 and the push-button guide 20.

The push-button switch assembly 1 also has a light source unit 50 with a light-emitting diode 51, which, in relation to the longitudinal axis L, is coupled to the push-button guide 20 by means of a coupling sleeve 26 at an end opposite the actuation head 10, so that a light beam from the light-emitting diode 51 can be coupled into the light guide 40 at the bottom end 48 of the light guide 40. A light beam emitted from the light-emitting diode 51 enters the light guide 40 in this direction, is guided in and decoupled from the light guide 40 at the continuous edge of the funnel-shaped element 42 and the protruding region 45 of the disc-shaped element 43 and thus provides a clearly recognizable illumination of the push-button switch assembly 1, making locating and indicating the push-button switch assembly 1 reliable.

In addition, one or more spring elements 22 are shown which preload the push-button switch assembly 1 or components of the push-button switch assembly 1 adjacent to the spring element 22. In this way, a basic status of the push-button switch assembly 1 can be set up, which can be transferred to a switch status by actuation by means of pressing and/or turning. The push-button switch assembly 1 can be switched, for example, from a non-released state to a released state by actuating the actuation head 10, wherein the push-button switch assembly 1 is designed such that, in the released state, an electrical contact between two conductors of a contact element, which can be coupled to the push-button switch assembly 1, can be separated if the contact element is designed as an N/C contact and the electrical contact between the two conductors is closed in the non-released state. The push-button switch assembly 1 realizes, for example, an emergency stop switch or a stop switch and, by means of the specifically designed locking unit 60 and the light guide 40, allows for a particularly reliable set-up and clearly recognizable display of a switch status and thus contributes to safety.

The push-button switch assembly 1 further comprises an annular adapter device 30 for fastening the push-button switch assembly 1 to a housing body. According to standard specifications, individual components of the push-button switch assembly 1 have predetermined color designs. With regard to an emergency stop switch, the push-button guide 20 has a green integrally-colored material, in particular an integrally-colored plastic, the color of which differs significantly from a red color of the actuation head 10 and a yellow color of the adapter device 30.

Figure 2A:
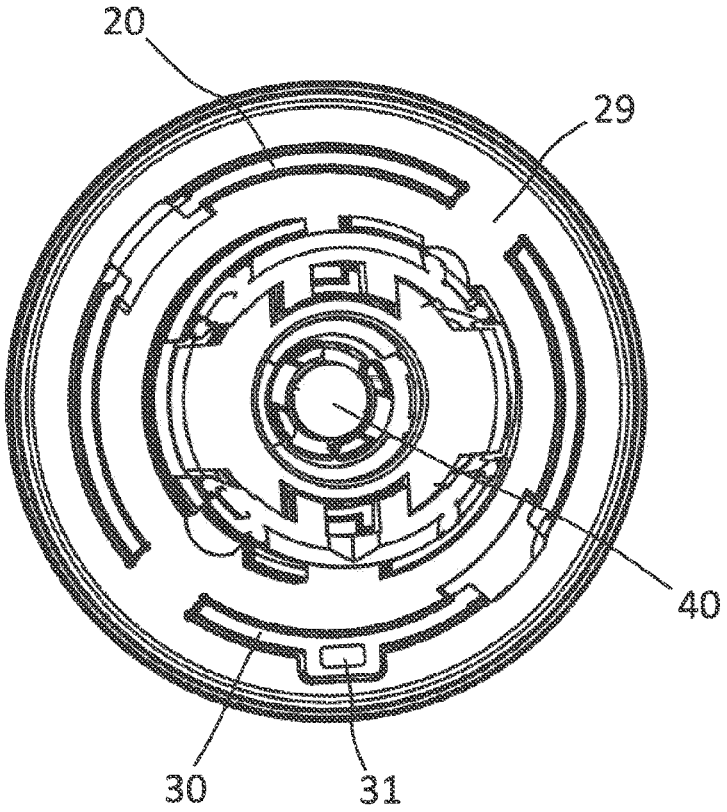
FIG. 2A-2C show different cross sections of the push-button switch assembly according to FIG. 1.
Figure 2B:
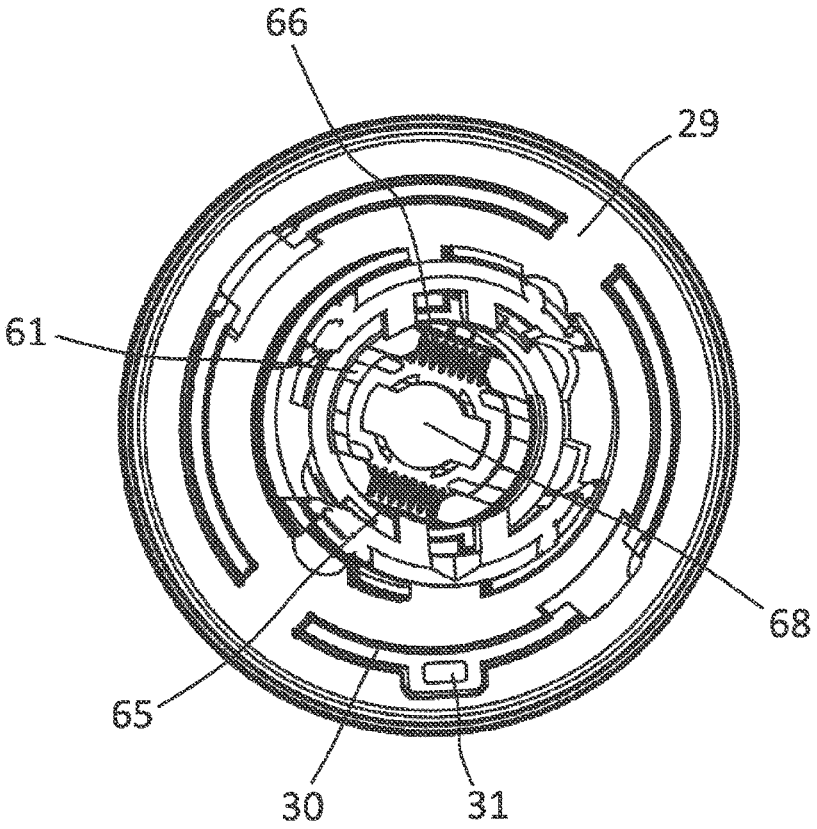
Figure 2C:
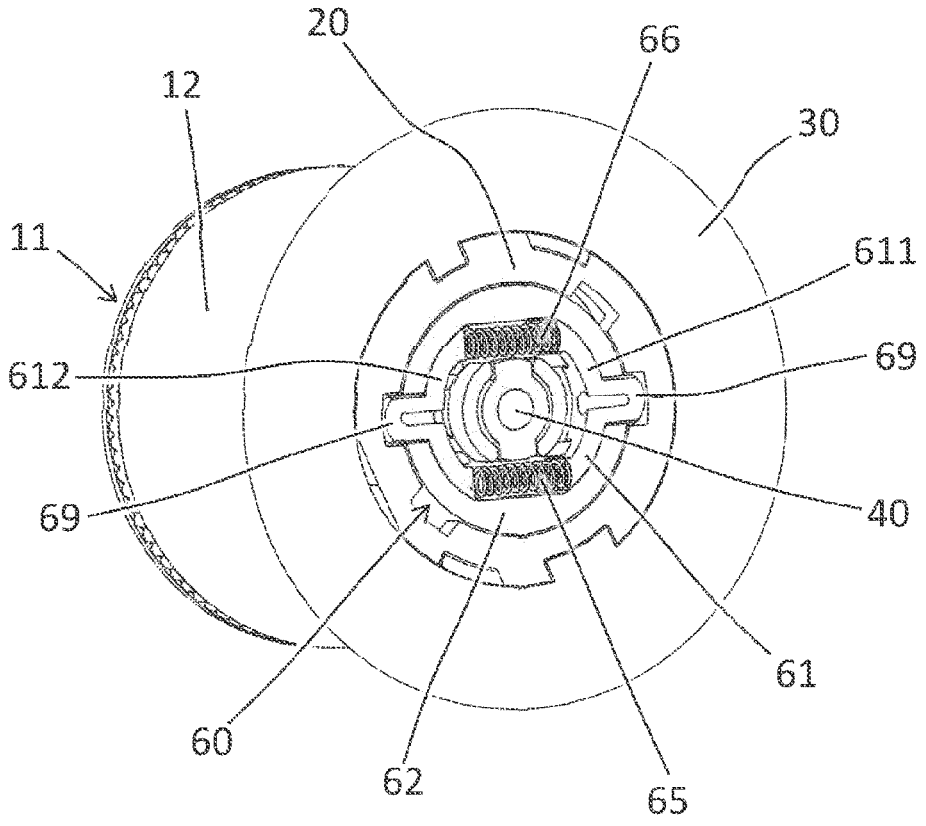

FIG. 2A to 2C are different views of the push-button switch assembly 1 from below in the direction of the actuation head 10. FIG. 2A shows, among other things, the central arrangement of the light guide 40 within the push-button guide 20 and the adapter device 30. In addition, the light guide 40 is surrounded by an adapter centering 29. The adapter centering 29 interacts, among others, with a blocking element 31 of the adapter device 30, which form an anti-twist safeguard for the adapter device 30.

FIG. 2B shows a depiction of the push-button switch assembly 1 with a view of the locking unit 60 without the light guide 40. Using this depiction, it can be seen that the described configuration of the locking unit 60 has or delimits a centrally formed free through-opening 68, thus allowing for an unimpeded passage of light centrally along the longitudinal axis L. A passage of light preferably takes place within the centrally arranged light guide 40 which, due to the specific design of the locking unit 60, can extend through the through-opening 68 up to the light source unit 50. A certain freedom of movement of the light guide 40 along the longitudinal axis L must be taken into account due to the actuation of the push-button switch assembly 1 by pressing the actuation head 10.

FIG. 2C is a perspective sectional view along a plane transverse to the longitudinal axis L of the adapter device 30 and the locking unit 60. The locking unit 60 has two locking elements 69, each in the form of a rounded bolt, which are arranged on opposite sides of the detent catch 61 in relation to the longitudinal axis L. According to this embodiment, the locking elements 69 are designed to be hollow or sleeve-like and integral with sickle-shaped detent catch elements 611, 612.

Figure 3A:
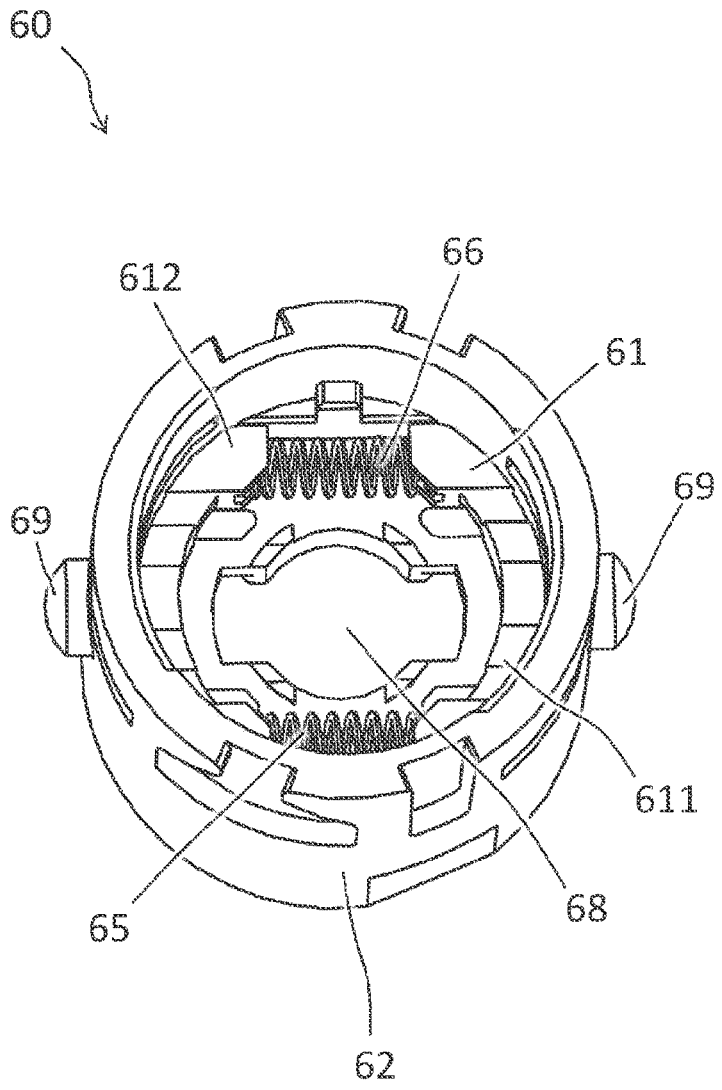
FIG. 3A-3E show an embodiment of a locking unit for the push-button switch assembly according to FIG. 1.
Figure 3B:
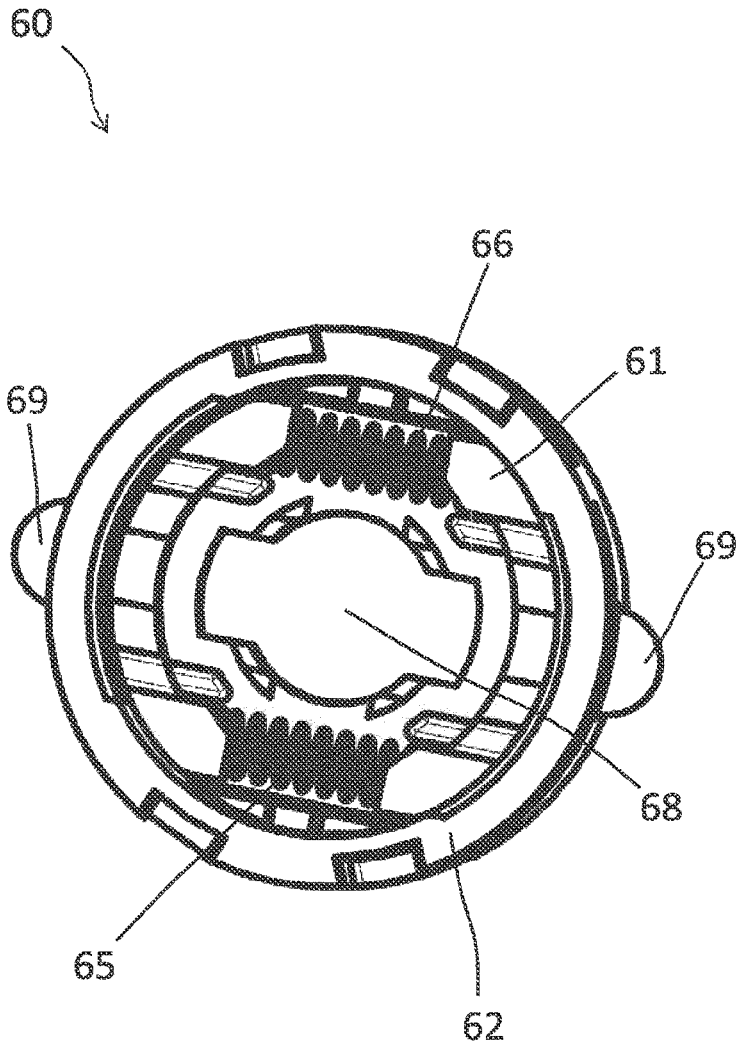
Figure 3C:
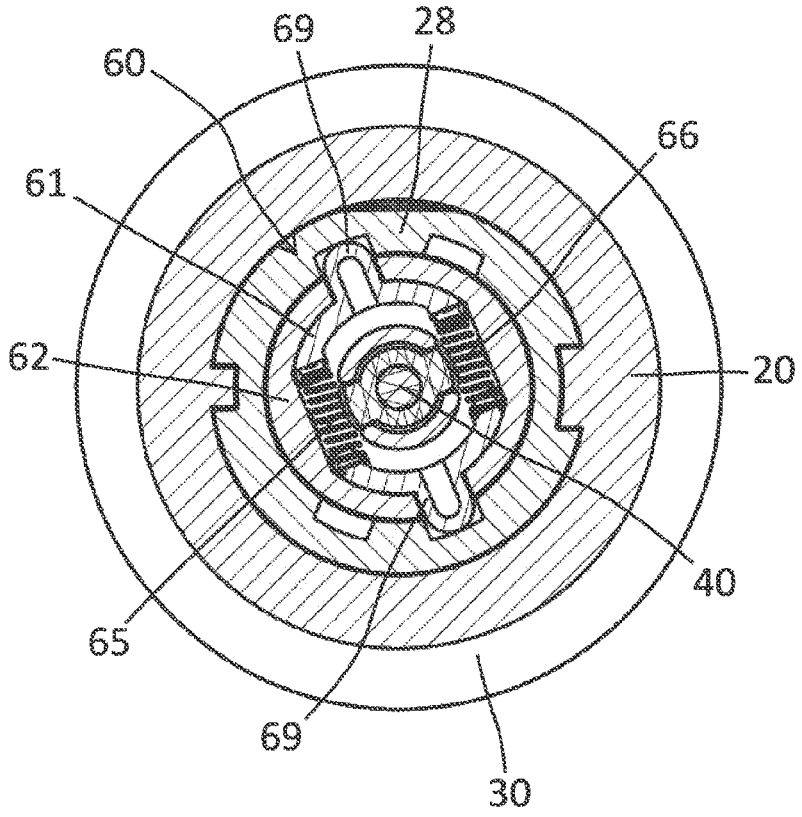
Figure 3D:
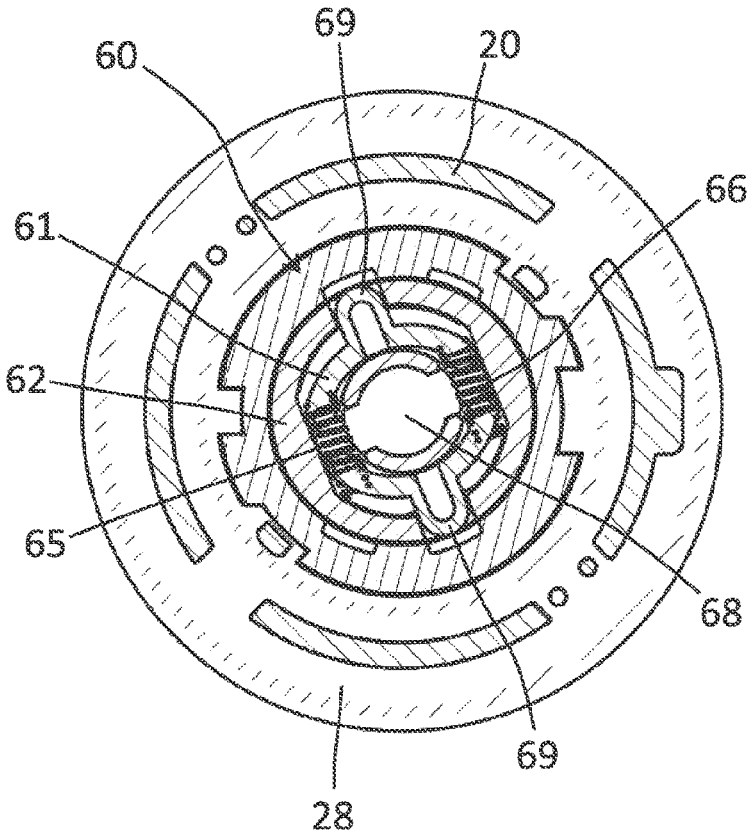
Figure 3E:
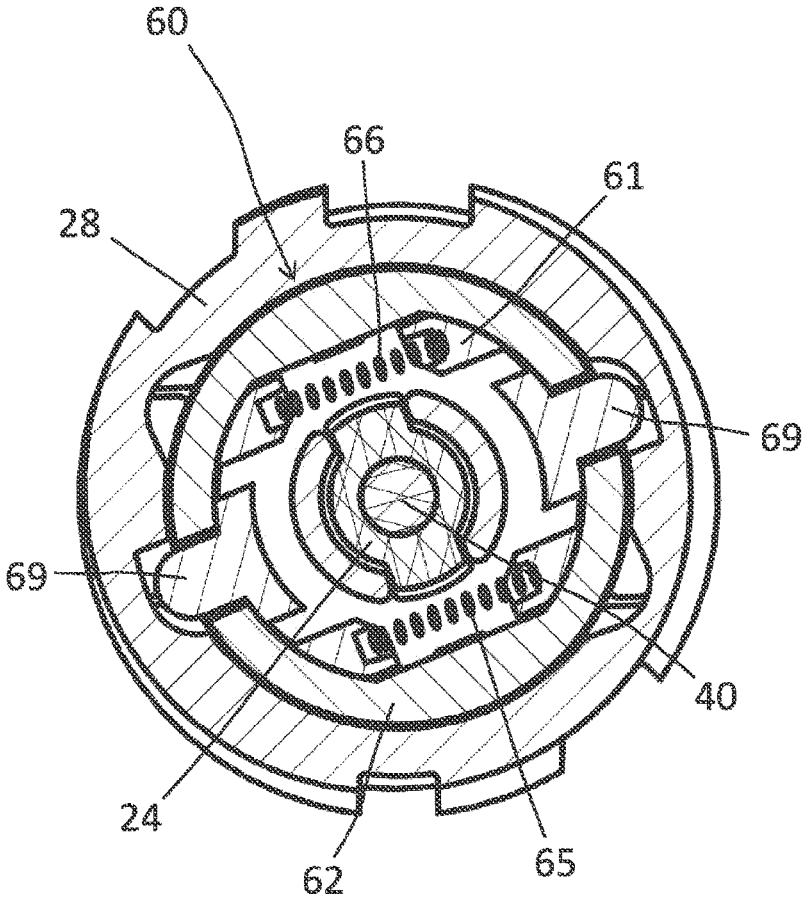

FIG. 3A to 3E are different views of a preferred embodiment of the locking unit 60. FIGS. 3A and 3B show respective perspective depictions the locking unit 60. FIG. 3C to 3E are sectional views of the locking unit 60. The locking unit 60 has the plunger sleeve 62, within which the detent catch 61 designed in two parts is arranged. The detent catch 61 comprises the first and second detent catch element 611 and 612 which are preloaded by two spring elements 65, 66 which push the detent catch elements 611 and 612 outward and away from the central longitudinal axis L. The respective locking elements 69 are designed, for example, as solid bolt-shaped elements integral with the respective detent catch element 611, 612 and extend outward through a wall of the plunger sleeve 62.

The plunger sleeve 62 also has grooves or recesses that allow for a stable engaging and secure coupling to surrounding components of the push-button switch assembly 1. The plunger sleeve 62 is coupled to the push-button guide 20 by means of a guide ring 28 (see FIG. 1). In addition, the plunger sleeve 62 and the detent catch 61 or the detent catch elements 611 and 612 have guide elements, by means of which the detent catch elements 611, 612 can be moved in a guided manner relative to the plunger sleeve 62. Raised elongated guide structures are provided on a bottom of the plunger sleeve 62, which engage in corresponding grooves on the detent catch elements 611, 612 and predetermine a movement of the detent catch elements 611, 612 along the guide structures.

FIG. 3C shows a cross section of the push-button switch assembly 1 at the level of the locking unit 60 which represents, for example, a first locking setting or basic setting. The locking elements 69, pushed by the spring forces of the spring elements 65, 66, engage in provided recesses. In comparison thereto, a movement of the locking unit 60 or the detent catch elements 611, 612 is indicated in FIG. 3D, as initiated by a turning process of and/or a pressing process on the actuation head 10. The locking elements 69 move away from the respective recesses and are moved in the direction of the central longitudinal axis L against the acting spring forces. When the turning and/or pressing process is continued, the locking elements 69 are rotated, for example, radially about the longitudinal axis until they engage in further recesses provided for this purpose and form a second locking state of the locking unit 60 and a switch status of the push-button switch assembly 1. According to the embodiment shown in FIGS. 3C and 3D, a clockwise rotary movement can take place until the locking elements engage in adjacent recesses of the guide ring 28.

FIG. 3E shows a cross section of the locking unit 60 in a released or actuated state of the push-button switch assembly 1, by means of which a rounded contour of the recesses, in which the bolt-shaped locking elements 69 engage or can engage, can also be seen.

The through-opening 68 of the locking unit 60 is, among others, also delimited in a predetermined manner by the bottom of the plunger sleeve 62 (see FIGS. 3A, 3B and 3D). The delimiting contour in the bottom of the plunger sleeve 62 can in particular be designed to match the use of the light guide 40 or the plunger 24 surrounding the light guide 40 in order to ensure reliable guiding through the through-opening 68 and contribute to a secure hold of the light guide 40 together with the plunger 24 in the push-button switch assembly 1.

By means of the described push-button switch assembly 1, a switch status can be displayed for an operator in a reliable and clearly visible manner. The specifically designed locking unit 60 and the free space provided for the light guide 40 allow for a beneficial light function of the push-button switch assembly 1. In addition to conventional color markings, a light indicator can thus be realized and contribute to particularly reliable means for indicating a respective switch status.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments. The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Push-button switch assembly
10 Actuation head
11 Upper part of the actuation head
12 Lower part of the actuation head
20 Push-button guide of the push-button switch assembly
22 Spring element
24 Sleeve-type plunger
25 Sealing element
26 Coupling sleeve
28 Sleeve-type guide ring
29 Adapter centering
30 Adapter device of the push-button switch assembly
31 Blocking element of the adapter device
40 Light guide
41 Rod-shaped element of the light guide
42 Funnel-shaped element of the light guide
43 Disc-shaped element of the light guide
45 Protruding region of the disc-shaped element
46 Hollow space of the light guide
47 Top end of the light guide
48 Bottom end of the light guide
50 Light source unit
51 Light-emitting diode of the light source unit
60 Locking unit
61 Detent catch of the locking unit
611 First detent catch element
612 Second detent catch element
62 Plunger sleeve
65 First spring element of the locking unit
66 Second spring element of the locking unit
68 Through-opening of the locking unit
69 Detent catch

The invention claimed is:

1. A push-button switch assembly with means for indicating a switch status, comprising:

an actuation head configured to actuate the push-button switch assembly, the actuation head having a disc-shaped upper part and a tubular lower part;

a sleeve-type push-button guide which is coupled to the actuation head such that, in relation to a longitudinal axis of the push-button switch assembly, the upper part is arranged above the push-button guide and the lower part surrounds the push-button guide;

a sleeve-type locking unit configured to determine a switch status of the push-button switch assembly, the sleeve-type locking unit being arranged within the push-button guide in relation to the longitudinal axis and being transferrable between a first and a second locking state by the actuation head, the locking unit having a plunger sleeve and an annular detent catch coupled to the plunger sleeve, which delimit a central through-opening through the locking unit perpendicular to and along the longitudinal axis in a predetermined manner, the detent catch comprising a multipiece design and a first detent catch element and a second detent catch element which are preloaded by two spring elements which, in relation to the longitudinal axis, push the detent catch elements outward; and a light guide configured to guide light, which light guide is coupled to the actuation head such that, in relation to the longitudinal axis, at least portions of the light guide are arranged within the actuation head and within the push-button guide, the light guide, in relation to the longitudinal axis, extending with a top end in a predetermined position through the actuation head and with a bottom end, extending through the through-opening of the locking unit such that the push-button switch assembly is illuminatable in a predetermined manner by a light beam that is couplable into the light guide at the bottom end.

2. The push-button switch assembly of claim 1, wherein the detent catch of the locking unit has a locking element on an outer side and is preloaded by a spring element which, in relation to the longitudinal axis, is configured to push the detent catch and the locking element outward.

3. The push-button switch assembly of claim 1, wherein the detent catch elements each have a locking element on an outer side.

4. The push-button switch assembly of claim 3, wherein the respective locking element is bolt-shaped with a rounded end facing away from the central through-opening.

5. The push-button switch assembly of claim 3, wherein the detent catch, in relation to the longitudinal axis, is arranged within the plunger sleeve and the respective locking element extends through an opening in a wall of the plunger sleeve.

6. The push-button switch assembly of claim 1, wherein the plunger sleeve and/or the detent catch have guide elements by which the detent catch is movable in a guided manner relative to the plunger sleeve.

7. The push-button switch assembly of claim 1, further comprising:

a light source unit with a light-emitting diode which, in relation to the longitudinal axis, is coupled to the push-button guide below the locking unit at an end opposite the actuation head such that a light beam of the light emitting diode is emittable unblocked through the through-opening of the locking unit in a direction of the actuation head.

8. The push-button switch assembly of claim 1, wherein the push-button switch assembly is switchable from a non-released state to a released state by actuating the actuation head, wherein the push-button switch assembly is configured such that, in the released state, an electrical contact between two conductors of a contact element, which is couplable to the push-button switch assembly, is separable if the contact element comprises an N/C contact and the electrical contact between the two conductors is closed in the non-released state, and wherein the push-button switch assembly is configured such that, in the released state, an electrical contact between two conductors in the contact element is closable if the contact element comprises an N/O contact and the electrical contact between the two conductors is separated in the non-released state.

* * * * *